US009310155B2

(12) United States Patent
Langley

(10) Patent No.: US 9,310,155 B2
(45) Date of Patent: Apr. 12, 2016

(54) COMPOUND BOW SYSTEM

(71) Applicant: Bear Archery, Inc., Evansville, IN (US)

(72) Inventor: Timothy Langley, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 37 days.

(21) Appl. No.: 14/146,782

(22) Filed: Jan. 3, 2014

(65) Prior Publication Data

US 2014/0190460 A1 Jul. 10, 2014

Related U.S. Application Data

(60) Provisional application No. 61/749,564, filed on Jan. 7, 2013.

(51) Int. Cl.
*F41B 5/10* (2006.01)
*F41B 5/14* (2006.01)
*F41B 5/00* (2006.01)

(52) U.S. Cl.
CPC . *F41B 5/10* (2013.01); *F41B 5/105* (2013.01); *F41B 5/0094* (2013.01); *Y10S 124/90* (2013.01)

(58) Field of Classification Search
CPC ..... F41B 5/10; F41B 5/105; F41B 5/0094; Y10S 124/90
USPC ..... 124/23.1, 25.6, 86, 88, 900
See application file for complete search history.

(56) References Cited

U.S. PATENT DOCUMENTS 3,923,035 A * 12/1975 Trotter ..... F41B 5/105 124/25.6
3,967,609 A * 7/1976 Frydenlund ..... 124/25.6
4,401,097 A * 8/1983 Simonds ..... F41B 5/10 124/25.6
4,457,288 A * 7/1984 Ricord ..... F41B 5/10 124/25.6
4,458,657 A 7/1984 Stockmar
4,465,054 A * 8/1984 Nishioka ..... F41B 5/10 124/25.6
4,512,326 A * 4/1985 Jarrett ..... F41B 5/10 124/25.6
4,593,674 A * 6/1986 Kudlacek ..... F41B 5/10 124/25.6
4,649,890 A * 3/1987 Powers ..... F41B 5/105 124/25.6
4,858,588 A * 8/1989 Bozek ..... F41B 5/10 124/23.1
5,638,804 A * 6/1997 Remick ..... F41B 5/10 124/25.6
5,749,351 A 5/1998 Allshouse et al.
5,950,609 A * 9/1999 Thielen ..... F41B 5/10 124/25.6
5,967,132 A * 10/1999 Loomis ..... F41B 5/10 124/25.6
6,029,644 A * 2/2000 Bronnert ..... F41B 5/0094 124/23.1
6,067,974 A * 5/2000 Islas ..... F41B 5/0094 124/25.6
6,470,870 B1 * 10/2002 Schaar ..... F41B 5/10 124/25.6
6,698,413 B1 3/2004 Ecklund
6,776,148 B1 * 8/2004 Islas ..... F41B 5/10 124/25.6
6,792,931 B1 * 9/2004 Schaar ..... F41B 5/10 124/25.6
7,047,958 B1 * 5/2006 Colley ..... F41B 5/105 124/25.6
7,201,161 B1 4/2007 York (Continued)

*Primary Examiner* — Alexander Niconovich
(74) *Attorney, Agent, or Firm* — Woodard, Emhardt, Moriarty, McNett & Henry LLP

(57) ABSTRACT

Certain embodiments of the present disclosure describe a compound archery bow that has a rigid vertical riser structure. At least one flexible limb extends rearward from the vertical riser structure. One end of the flexible limb is secured to the cable arrangement of the compound bow, so that when the bowstring is drawn, the flexible limb is flexed toward the cams of the bow. As the flexible limb is bent, it stores energy that is transferred to an arrow when the bowstring is released.

20 Claims, 7 Drawing Sheets

(56) References Cited

U.S. PATENT DOCUMENTS 7,637,256 B2 * 12/2009 Lee ..... F41B 5/105 124/25.6
8,387,603 B2 * 3/2013 Darlington ..... F41B 5/10 124/23.1
8,522,762 B2 * 9/2013 Trpkovski ..... F41B 5/0094 124/23.1
8,651,095 B2 * 2/2014 Islas ..... F41B 5/105 124/25
8,833,349 B2 * 9/2014 Park ..... F41B 5/0094 124/25.6
8,899,217 B2 * 12/2014 Islas ..... F41B 5/105 124/25.6
2007/0101980 A1 * 5/2007 Sims ..... F41B 5/10 124/25.6
2009/0032002 A1 * 2/2009 Howard ..... F41B 5/10 124/25.6
2009/0145411 A1 * 6/2009 Sims ..... F41B 5/10 124/25.6
2010/0071677 A1 * 3/2010 Cooper ..... F41B 5/10 124/25.6
2012/0006310 A1 * 1/2012 Sims et al. ..... 124/25
2014/0069405 A1 * 3/2014 Peacemaker ..... F41B 5/10 124/25.6

* cited by examiner

COMPOUND BOW SYSTEM

CROSS-REFERENCE TO RELATED APPLICATIONS

This application claims the benefit of U.S. Provisional Application No. 61/749,564 filed Jan. 7, 2013, which is hereby incorporated by reference in its entirety.

FIELD OF THE INVENTION

The present invention relates generally to archery bows.

BACKGROUND OF THE INVENTION

Traditional compound archery bows store energy by a cable arrangement involving a cable arrangement extending between rotational elements mounted at the ends of flexible limbs. Aspects of the present disclosure address a different type of arrangement.

SUMMARY OF THE INVENTION

Figure 1:
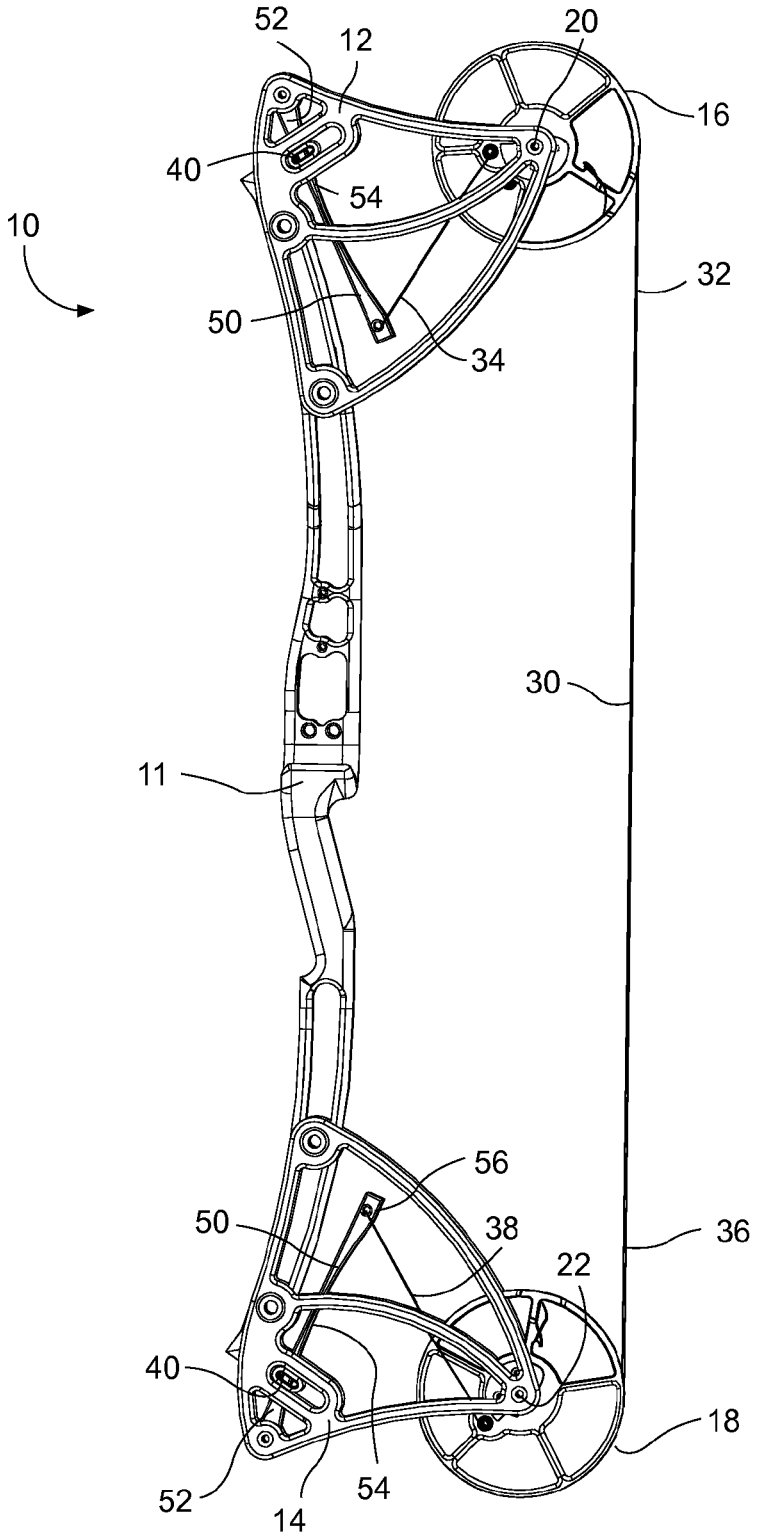
FIG. 1 is a side view of a compound bow system in an undrawn position incorporating a preferred embodiment of the present disclosure.

In certain embodiments, compound bow systems are illustrated with a rigid riser handle assembly including a long vertical portion and two end or rearward extending portions braced in a rigid, non-flexing structure. Mounted at the rearward corners of the upper and lower ends of the assembly are rotatable elements. A cable system forms a bowstring between the two rotatable elements. In certain embodiments, the cable arrangement is mounted to one or two flexible limb assemblies mounted to the rigid riser assembly. As the bowstring is drawn, the flexible limb or limbs are flexed toward the cams.

One aspect of the present embodiments is the use of a rigid riser structure where the rotating elements are directly connected to the rigid structure rather than flexible limbs. An alternate aspect is that the flexible limb portions are mounted to the riser handle assembly with the moveable ends spaced away from and oriented in selected manners relative to the cams. In still another aspect, the fixed locations of the rotating elements provides a fixed axle to axle distance that does not change during the draw or release cycle.

Other objects and attendant advantages will be readily appreciated as the same become better understood by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

At a broad level, a compound bow system is illustrated with a rigid vertical riser structure including a long vertical portion and two ends extending rearward from the vertical riser portion and braced in a rigid, non-flexing structure. Mounted to axles at the rearward corners of the upper and lower ends are upper and lower rotatable elements, either as circular wheels or elements which are mounted as eccentric cams or defining eccentric tracks. A cable system forms a bowstring between the two rotatable elements. In one embodiment, a cable extends between the two rotatable elements and has two ends with each end connected to an anchor point on a respective rotatable element. Another cable is attached on one end to an anchor post on the rotatable element and its other end is attached to a flexible limb mounted within an interior angle of a rearward extending portion. As the bowstring is drawn, the flexible limbs are flexed toward the rotatable elements and thereby store energy. In an alternate illustrated embodiment, the cable system has one end connected to a flexible limb located in the internal angle of a rearward extending portion, with the other end anchored to an eccentric cam. In that embodiment, the entire stored energy during the draw is within one flexible limb.

One aspect of the present embodiments is the use of a rigid riser structure where the rotating elements are directly connected to the rigid structure rather than flexible limbs. Another aspect is that the flexible limb portions are mounted to the riser handle assembly with the moveable tips spaced away from the cams. In still another feature, the fixed locations of the rotating elements provides a fixed axle to axle distance that does not change during the draw or release cycle.

FIG. 1 illustrates an example of a compound archery bow generally designated as 10. When viewed from the perspective of an archer holding the bow, it includes a vertical riser structure 11 with a handle, an upper rearward extending portion 12 and a lower rearward extending portion 14. Riser structure 11 includes a rigid vertical handle portion which extends or is connected to braced and rigid, non-flexing rearward extending corner portions 12 and 14. Each corner portion extends rearward.

Figure 2:
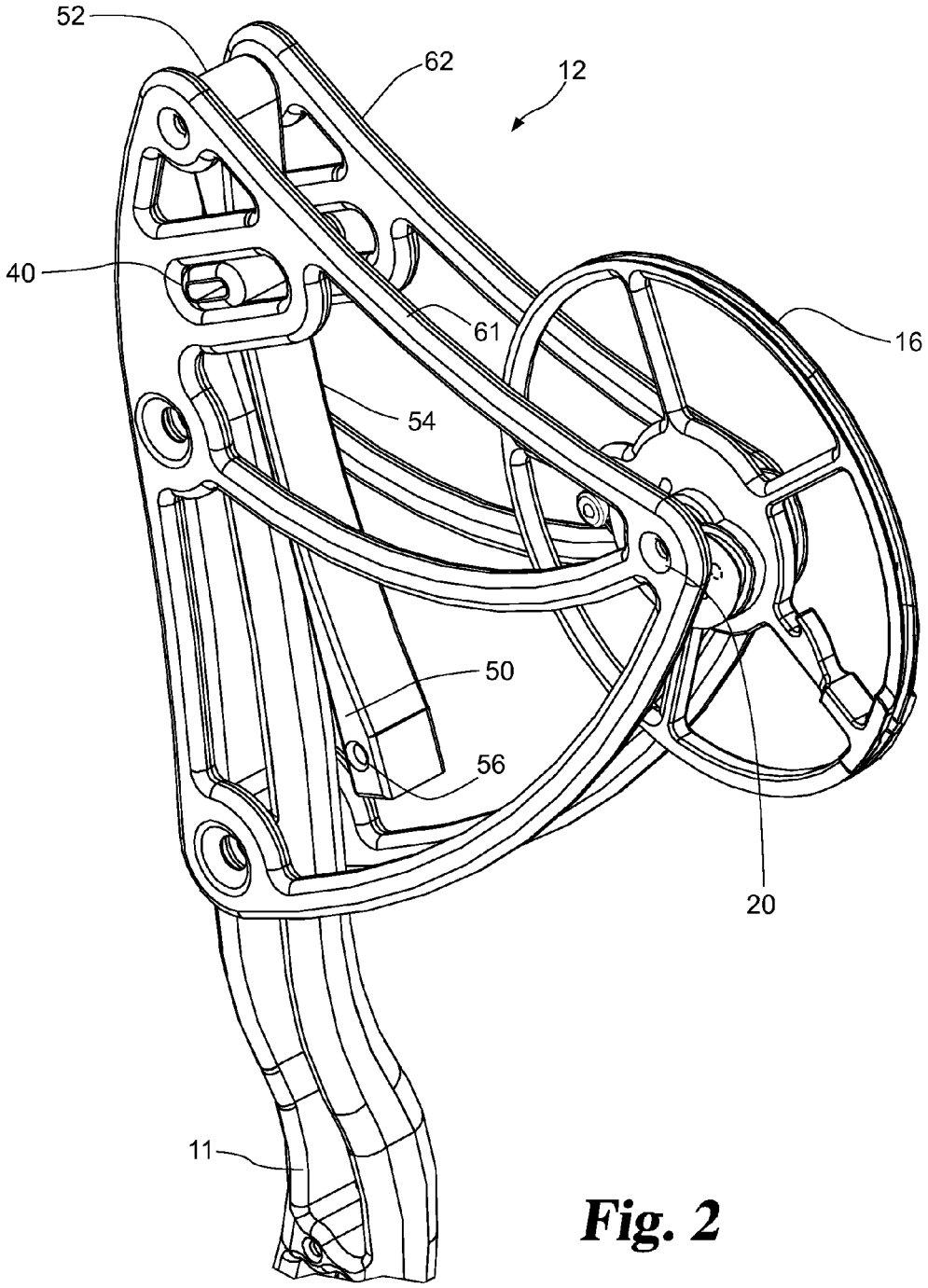
FIG. 2 is a perspective view of the upper portion of the compound bow system of FIG. 1.

The illustrated riser structure optionally has areas removed or "skeletonized" to reduce weight and to allow visibility. A riser assembly including the vertical portion and extensions may be formed of a one-piece unitary construction or can be made as a multi-piece assembly. For example, the extensions may be formed separately and then mounted to the vertical handle portion using a permanent connection, such as welding or rivets, or using a connection which can be selectively disconnected, such as a bolts and nuts arrangement. As illustrated in FIG. 2, upper rearward extending portion 12 and lower rearward extending portion 14 are each formed of parallel, roughly triangular plate portions 61 and 62 rigidly connected on opposing sides of the upper and lower ends of the vertical handle portion.

In the example illustrated, rotational elements such as upper wheel 16 and lower wheel 18 are supported at the rearward tip sections of each of upper rearward extending portion 12 and lower rearward extending portion 14 for rotary movement about axles 20 and 22. An upper pulley axle 20 is carried between mounting points adjacent a rearward tip of upper rearward extending portion 12. A lower pulley axle 22 is carried between mounting portions adjacent a rearward tip of lower rearward extending portion 14.

Figure 5:
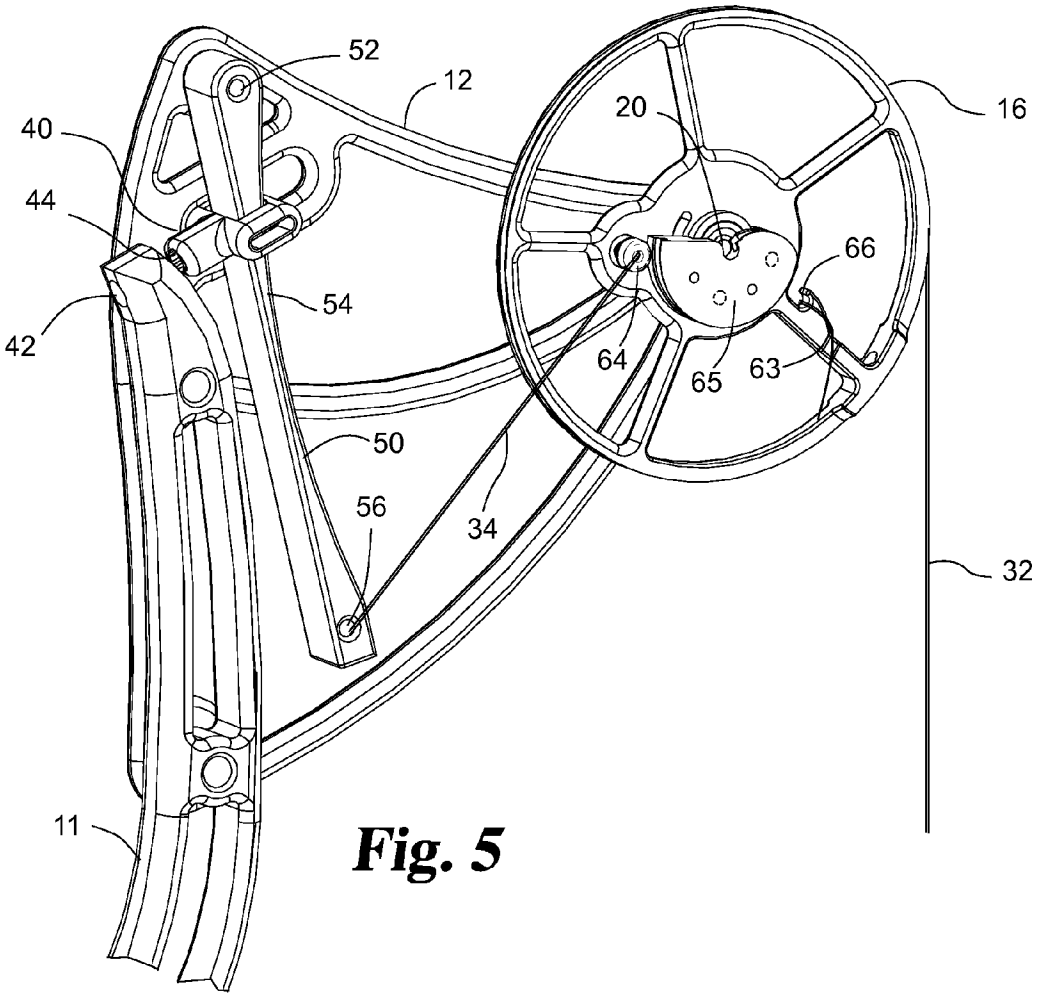
FIG. 5 is an enlarged view of a portion of the embodiment of FIG. 1 with a side plate removed for illustration.

A cable arrangement defines a bowstring 30. Bowstring 30 includes an upper portion 32 and a lower portion 36 which are fed-out from wheels 16 and 18 as the bow is drawn (see FIG. 8). As illustrated in FIG. 5, the upper and lower portions 32 and 36 each form part of a medial portion which extends around wheel 16 or 18 and are attached to a respective wheel at anchor point 66 on one of the wheels. A separate power cable 34 is anchored on a post 64 on the wheel adjacent an eccentric cam track, for example on a module 65 and extends to a limb tip 56. When the bow is drawn and the bowstring 30 is fed out from the wheels 16, 18, the power cable 34 is wrapped around the cam track causing the flexible limb 50 to bend and store energy. From the perspective of the archer, the bowstring is considered rearward relative to the riser which defines forward.

The embodiment illustrated in FIG. 1 includes two flexible limb assemblies, which are essentially mirror images of each other, mounted on the vertical riser structure 11. In the embodiment shown, each flexible limb assembly includes a flexible limb 50 mounted in an extension such as rearward extending portion 14. As illustrated in FIG. 2, each limb 50 is mounted in a gap between the pair of plates 61 and 62 forming a respective upper or lower rearward extending portion.

Figure 3:
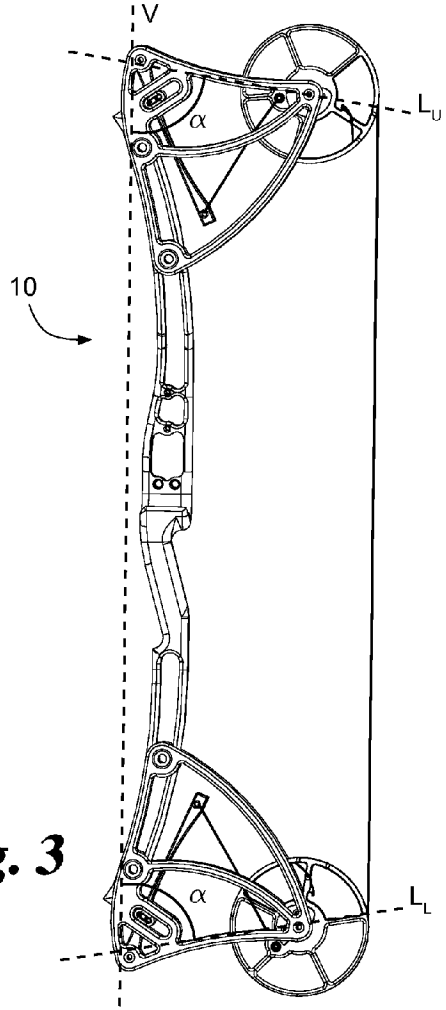
FIG. 3 is a side view of the embodiment of FIG. 1 showing various axes and angles of a compound bow system.

In the option illustrated in FIG. 3, each limb 50 is mounted in an interior angle a defined with a vertex at the respective upper or lower forward corner area of the rearward extending portions and measured between a limb axis $L_L$ or $L_U$ extending toward the respective rotational element and a vertical riser axis V defined by the handle portion. Riser axis V may lie over the riser or may be a parallel axis that intersects the limb mounting points. The flexible limb 50 extends rearward, toward the bowstring, within the internal angle a shown in FIG. 3.

Figure 4:
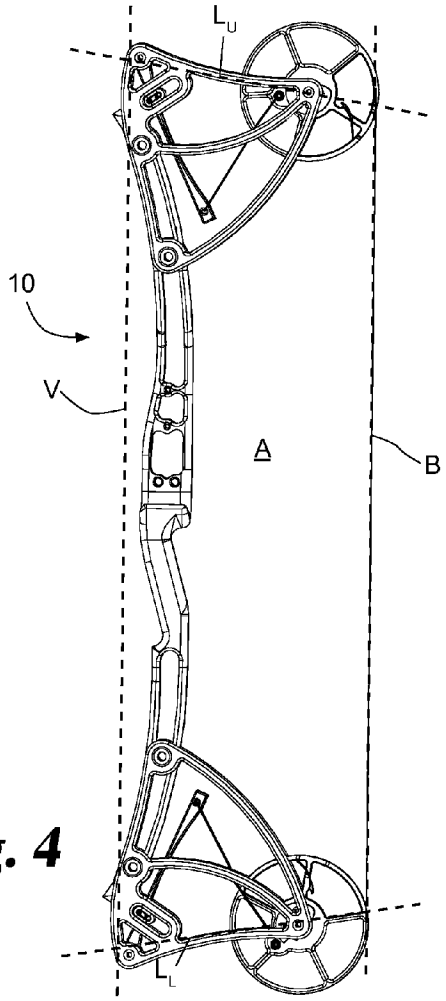
FIG. 4 is a side view of the embodiment of FIG. 1 showing an area defined by the compound bow system.

Alternatively, the position of the flexible limb 50 can be described as within an area (shown as A in FIG. 4) defined by several of the elements of the archery bow 10. This area is defined as the space that is surrounded by an axis V of the vertical riser structure 11, the limb axes $L_L$ and $L_U$, and the bowstring axis B. The flexible limb 50 is mounted on the riser structure 10 so that it extends rearward into this area.

The flexible limb 50 includes a butt end 52 anchored on the vertical riser assembly, for example via a pivot mount to the upper, forward corner area of upper rearward extending portion 12 as shown in FIG. 2. The flexible limb includes a middle portion 54 and extends to a limb tip 56. Limb tip 56 is coupled to an end of the power cable 34 extending from post 64 on the wheel 16. In FIG. 1, power cable 34 is mounted to a flexible limb 50 in the upper rearward extending portion 12 while power cable 38 is mounted to a flexible limb 50 in the lower rearward extending portion 14.

As shown in FIG. 5, the flexible limb 50 optionally extends through an opening in a brace 40 that is mounted in one of the rearward extending portions 12 or 14 of the vertical riser structure 11. Brace 40 defines a fulcrum point around which limb 50 can bend while anchored at butt end 52 and drawn by force applied to limb tip 56. The position of brace 40 is optionally adjustable to selectively adjust the bending characteristics of the flexible limb assembly. In one embodiment of the invention, the brace 40 is adjusted by the use of a bolt inserted through an opening 42 on the front face of the vertical riser structure 11 and received in a threaded opening 44 in the brace 40. The position of brace 40 is changed by rotating the bolt to pull it towards or away from riser structure 11. Brace 40 may optionally be sufficiently adjustable to allow tension to be released from the cable arrangement to allow changes to the bowstring or to cam modules without using a bow press.

The limb assemblies are illustrated with a limb 50 having butt end 52 in substantially the uppermost or lowermost forward corner of the respective upper or lower rearward extending portion 12 or 14. The limbs 50 extend upward from the lower rearward extending portion or downward from the upper rearward extending portion. At least a portion of the braces 40 are rearward of the limbs, while the limbs are angled rearward. This orients limb tips 56 with respect to the power cables 34 and 38 so that when bow 10 is drawn, power cables 34 and 38 draw limb tips 56 and the corresponding limbs towards wheels 16 and 18 respectively against the braces. While limb tips 56 move in a slightly curved path overall (compare FIG. 1 and FIG. 8) defined by the length and bend of flexible limbs 50, the limb orientation is geometrically arranged in certain embodiments so that primarily a vertical force vector rather than a horizontal force vector is applied to or by limb tips 56 during the draw and release cycle. This is accomplished by optionally positioning the limb 50 so that the vertical distance from the limb tip 56 to the rotatable element 16 or 18 is greater than the horizontal distance from the limb tip 56 to the rotatable element 16 or 18. In the illustrated embodiment, the vertical force vectors of the upper and lower flexible limbs preferably substantially cancel each other, preferably dampening vibration of the bow upon a release.

Other angular orientations or placement of limbs relative to rotational elements, with different force vector characteristics based on each orientation, may also be used. For example, in certain alternate embodiments two or more abutting or spaced limbs may be mounted in a rearward extending portion, for instance in a vertically stacked arrangement with parallel or radially arranged and braced limbs having linked limb tips, so that the limbs are coordinated and cooperate in a shared distribution of load and/or in a cumulative force effect to store and apply energy during the draw and release cycle.

In still further embodiments, the cable arrangement and limbs may be configured and braced to bend the limbs in either direction from an undrawn position. In certain embodiments, a cable extending from a rotational element could be routed through a circular or eccentric pulley mounted above or below a limb tip before extending to the limb tip, and the bend direction of the limb can be controlled accordingly. Alternately in certain embodiments, a cable extending from a lower rotation element could extend to a resilient limb located in an upper rearward extending portion and/or a cable extending from an upper rotational element could extend to a limb located in a lower rearward extending portion. In embodiments where a cable portion crosses the central height area of the bow, a cable guard or offset mounting arrangement may be needed to prevent the cable portion from interfering with an arrow's flight.

Figure 8:
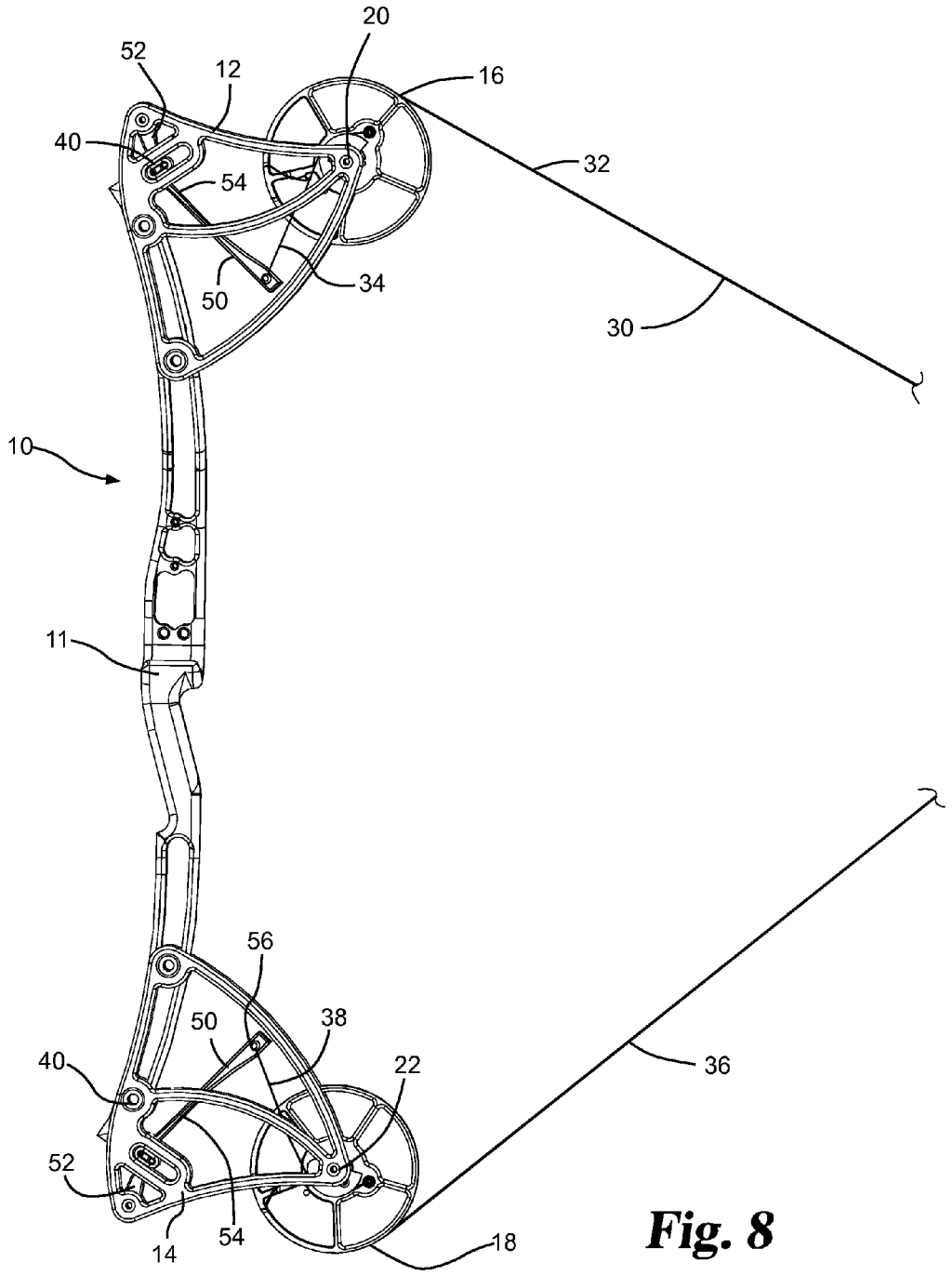
FIG. 8 is an illustration of the embodiment of FIG. 1 in a partially drawn position.

With respect to the embodiment shown in FIG. 1, as the bowstring 30 is being drawn as illustrated in FIG. 8, it causes wheels 16 and 18 at each end of the bow to rotate, feeding out cable to the bowstring. The rotation of wheels 16 and 18 causes power cables 34 and 38 to wind around the respective cams attached to the pulley axles 20 and 22 which bends limbs 50, with force specifically applied to bend limb tips 56 toward the wheels, causing energy to be stored in limbs 50.

When the bowstring 30 is released with an arrow engaged to the bowstring, the limbs 50 return to their rest positions, causing wheels 16 and 18 to rotate in the opposite direction, to take up the bowstring 30 and launch the arrow with an amount of energy proportional to the energy stored in the bow limbs. Bow 10 is described for illustration and context and is not intended to be limiting.

Figure 6:
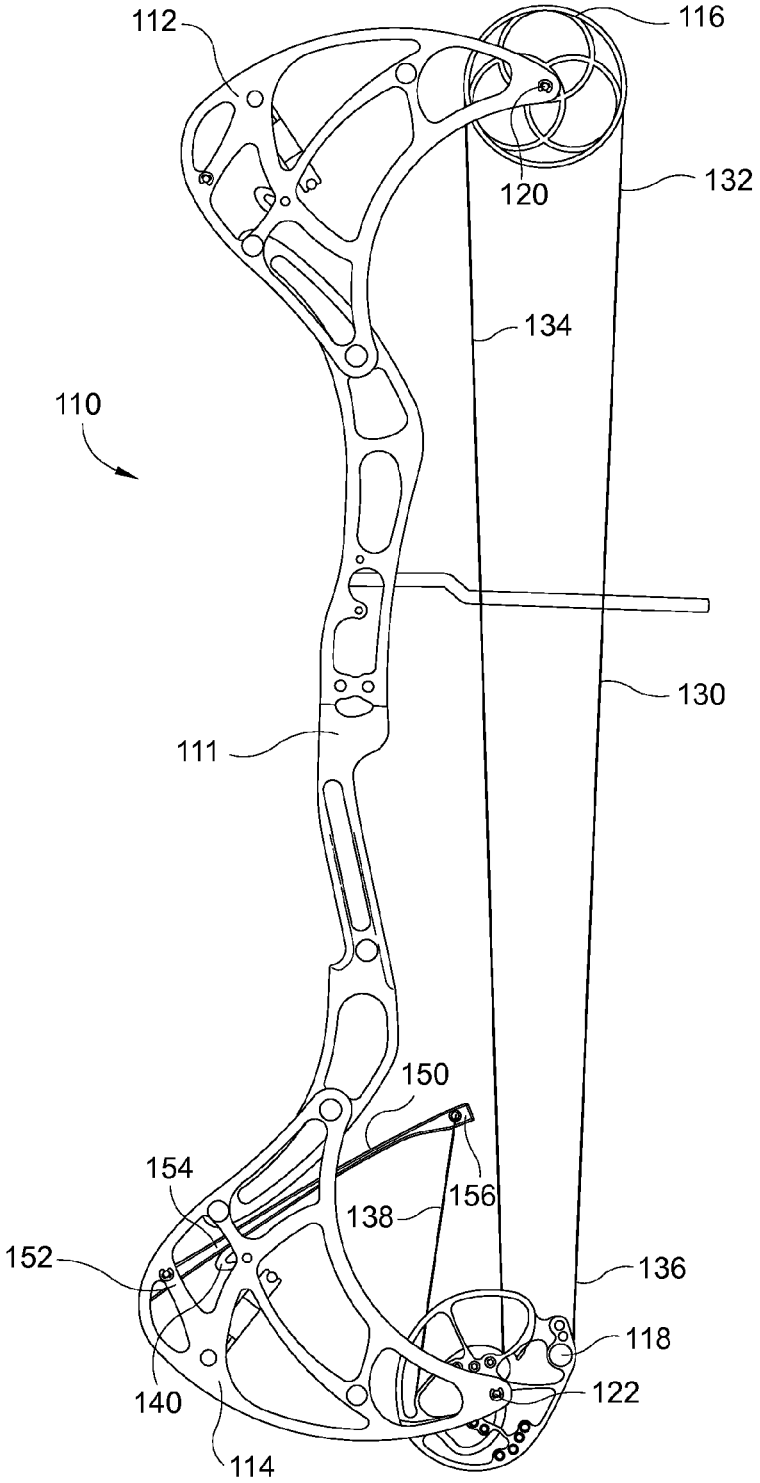
FIG. 6 is a side view of a compound bow system in an undrawn position incorporating an alternate preferred embodiment of the present disclosure.
Figure 7:
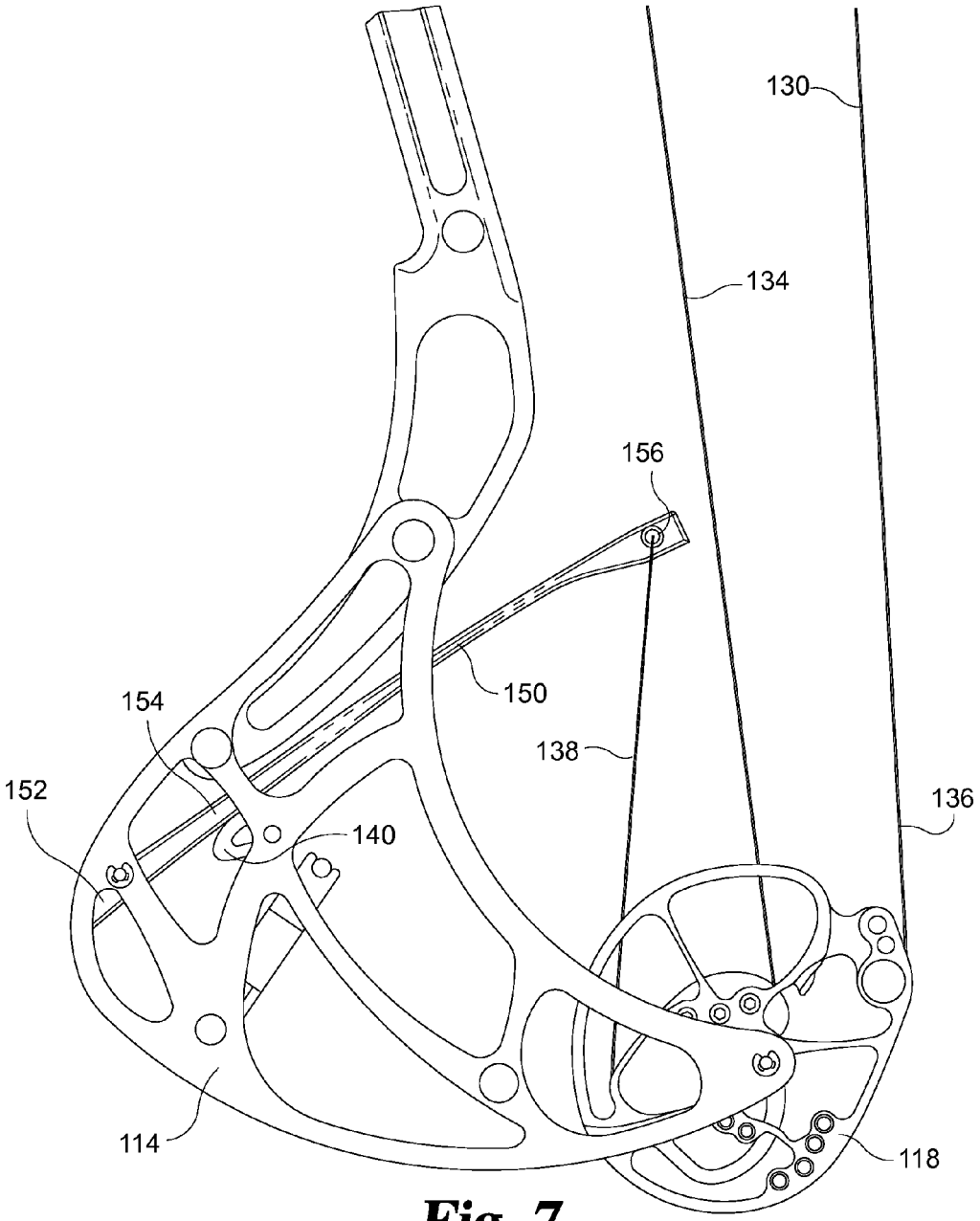
FIG. 7 is a detailed side view of the lower portion of the embodiment illustrated in FIG. 5.

FIGS. 6 and 7 illustrate an alternate embodiment of a compound archery bow system generally designated as 110. When viewed from the perspective of an archer holding the bow, it includes a riser structure 111 with a handle, an upper rearward extending portion 112 and a lower rearward extending portion 114. Riser structure 111 includes a rigid vertical handle portion which extends or is connected to braced and rigid, non-flexing rearward extending portions 112 and 114. As illustrated, upper rearward extending portion 112 and lower rearward extending portion 114 are each formed of parallel plate portions rigidly connected to the upper and lower ends of the vertical handle portion. The illustrated plate portions and riser optionally have areas removed or "skeletonized" to reduce weight and to allow visibility. Riser structure 111 including the vertical portion and rearward extending portions may be formed of a one-piece unitary construction or can be made as a multi-piece assembly. For example the rearward extending portions may be formed separately and then mounted to the vertical handle portion using a permanent connection, such as welding or rivets, or using a connection which can be selectively disconnected, such as a bolts and nuts arrangement.

In the example illustrated, rotational members such as upper wheel 116 and lower eccentric cam 118 are supported at the rearward tip sections of each of upper rearward extending portion 112 and lower rearward extending portion 114 for rotary movement about axles 120 and 122. Eccentric cam 118 may define one or more circular or eccentric cable tracks. An upper pulley axle 120 is carried between mounting points adjacent a rearward tip of upper rearward extending portion 112. A lower pulley axle 122 is carried between mounting portions adjacent a rearward tip of lower rearward extending portion 114.

A cable arrangement defines a bowstring 130. Bowstring cable 130 includes an upper portion 132 and a lower portion 136 which are fed-out from wheel 116 and cam 118 when the bow is drawn. In the illustrated embodiment, upper cable portion 132 forms a medial portion which wraps around wheel 116 and then forms a return cable 134 which extends around cam 118 and which extends to a flexible limb assembly. The lower portion 136 of cable 130 forms part of a medial portion which is anchored to eccentric cam 118. From the perspective of the archer, the bowstring is considered rearward relative to the riser which defines forward.

Preferably cam 118 and its tracks are engineered in combination with wheel 116 so that drawing bowstring 130 feeds cable 136 outward from cam 118 and feeds cable 134 towards and around wheel 116 in a ratio so that the nocking point of an arrow on bowstring 130 is maintained at a constant vertical height during the draw and release cycle. The use of one circular wheel and one eccentric cam with multiple tracks, and calculating the respective feed-out ratios, is comparable to how cams and cam tracks are engineered in compound bows commonly known as one-cam bows, with adjustments necessarily needed for the compound bow structure illustrated herein. Alternately, the upper and lower rotational elements can each be eccentric or define eccentric tracks.

The embodiment illustrated in FIG. 6 includes one flexible limb assembly, which is illustrated in detail in FIG. 7. The illustrated embodiment includes one flexible limb assembly at the lower end of the bow, but alternately one flexible limb assembly at the upper end of the bow could be used.

The flexible limb assembly includes a flexible limb 150 mounted on the vertical riser structure 111. Limb 150 is mounted in a gap between the pair of plates forming lower rearward extending portion 114. In the illustrated option, comparable to FIG. 3, limb 150 is mounted in an interior angle defined with a vertex at the lower forward corner area of the rearward extending portion and measured between the axis extending toward rotational element 118 and a vertical axis defined by the riser structure 111. Alternately, limb 150 can be described as extending within an area defined by the riser assembly and bowstring, comparable to FIG. 4. Flexible limb 150 extends rearward within the interior angle.

The flexible limb 150 includes a butt end 152 anchored on the vertical riser structure 111, for example with a pivot mount to the lower, forward portion of rearward extending portion 114. The flexible limb includes a middle portion 154 and extends to a limb tip 156. Limb tip 156 is coupled to an end of the cable arrangement 138 extending from bowstring 130.

The median portion 154 of limb 150 abuts a brace 140 mounted on the riser structure. Brace 140 defines a fulcrum point around which limb 150 can bend while constrained between anchored butt end 152 and limb tip 156. The position of brace 140 is optionally adjustable to selectively adjust the bending characteristics of the flexible limb assembly and/or to release tension from the cable arrangement without using a bow press. The limb assembly is illustrated with limb 150 having butt end 152 in the lowermost front corner of lower rearward extending portion 114, with the limb 150 extending upward from the lower rearward extending portion. The brace 140 is partially rearward of the limb, while the limb is also angled rearward. This orients limb tip 156 with respect to cable end 138 so that when bow 110 is drawn, cable end 138 draws limb tip 156 towards cam 118. While limb tip 156 moves overall in a slightly curved path defined by the length and bend of flexible limb 150, primarily a vertical force vector rather than a horizontal vector is applied to or by limb tip 156 during the draw and release cycle of the bow.

When the bowstring 130 is drawn, it causes rotational elements 116 and 118 at each end of the bow to rotate, feeding out cable to bowstring 130 and bending limb 150, specifically drawing limb tip 156 toward cam 118 and bending it against brace 140, causing energy to be stored in limb 150. When the bowstring 130 is released with an arrow engaged to the bowstring, the limb 150 returns to its rest position, causing rotational elements 116 and 118 to rotate in the opposite direction, to take up the bowstring 130 and launch the arrow with an amount of energy proportional to the energy initially stored in the flexible limb. Bow 110 is described for illustration and context and is not intended to be limiting.

The present disclosure can also be used in other types of bows, for example hybrid cam bows or crossbows, which are considered conventional for purposes of the present invention. Accordingly, it should be appreciated that the archery bow body can take on various designs in accordance with the many different types of bows with which the present invention can be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An archery bow, comprising:

a rigid vertical riser assembly with rearward extending portions;

upper and lower rotatable elements wherein each of said rotatable elements are mounted to respective rearward tip sections of said rearward extending portions;

at least one flexible limb including a base wherein the base of said flexible limb is mounted to said vertical riser assembly;

a cable arrangement defining a bowstring extending between said upper and lower rotatable elements, said bowstring forming upper and lower cable portions which each form a medial portion respectively trained around said upper and lower rotatable elements so that said bowstring extends directly between the upper and lower rotatable elements, said cable arrangement further including a return cable portion extending at one end from one of said upper and lower rotatable elements with an opposing end secured to said at least one flexible limb, said return cable portion extending directly between one of said upper and lower rotatable elements and said at least one flexible limb; and an area defined between said vertical riser assembly and said bowstring;

wherein said flexible limb extends rearward from said rigid vertical riser assembly into the area such that said flexible limb is positioned entirely within said area; and, wherein drawing said bowstring applies force to said flexible limb causing said limb to bend and store energy.

2. The archery bow as described in claim 1, comprising a second flexible limb wherein the base of said second flexible limb is mounted to said vertical riser assembly and wherein said second flexible limb extends rearward from said vertical riser structure into the area, such that said second flexible limb is positioned entirely within said area.

3. The archery bow as described in claim 1, wherein said vertical riser assembly comprises a brace wherein said brace engages said at least one flexible limb and defines a fulcrum point around which said flexible limb can bend.

4. The archery bow as described in claim 1 comprising an attachment point of said cable arrangement to said flexible limb;

wherein the vertical distance between the attachment point of said cable arrangement to said flexible limb and said rotatable element and a horizontal distance is defined between said attachment point of said cable arrangement to said flexible limb and said rotatable element;

wherein said vertical distance is greater than said horizontal distance so that when a force is applied to said flexible limb by said cable arrangement, said force is primarily vertical force; and, wherein said return cable portion is angled rearwardly within said vertical distance and said horizontal distance from said attachment point toward said rotatable element.

5. The archery bow as described in claim 1, wherein said rotatable elements are circular wheels.

6. The archery bow as described in claim 1, wherein said rearward extending portions are separate pieces mounted to a vertical riser structure.

7. The archery bow as described in claim 1, wherein said one end of said return cable is anchored to said rotatable element, and wherein said return cable portion is arranged to wrap around a cam track on said rotatable element when the bow is drawn.

8. The archery bow as described in claim 1, wherein said upper and lower rotatable members comprise a wheel and an eccentric cam, wherein one of said upper and lower bowstring cable portions forms a medial portion which wraps around said wheel, and which then forms a return cable which extends around an eccentric cable track on said eccentric cam and to said flexible limb.

9. An archery bow, comprising:

a rigid vertical riser assembly including an upper portion and a lower portion;

a rigid non-flexing portion extending rearward from the upper portion of said vertical riser assembly;

a rigid non-flexing portion extending rearward from the lower portion of said vertical riser assembly;

upper and lower rotatable elements mounted to said respective upper and lower rearward extending portions;

at least one flexible limb with a base mounted to said vertical riser assembly wherein said flexible limb extends rearward from said vertical riser assembly;

a cable arrangement defining a bowstring, said bowstring forming upper and lower cable portions which each form a medial portion respectively trained around said upper and lower rotatable elements so that said bowstring extends directly between the upper and lower rotatable elements and further including a return cable portion extending at one end from one of said upper and lower rotatable elements directly to said at least one flexible limb;

wherein an opposing end of said return cable portion is secured to said flexible limb; and, wherein drawing said bowstring applies force to said at least one flexible limb causing said limb to bend and store energy.

10. The archery bow described in claim 9, wherein said at least one flexible limb comprises upper and lower flexible limbs wherein each flexible limb extends rearward from said vertical riser assembly and wherein one end of said cable arrangement is secured to said upper flexible limb and the other end of said cable arrangement is secured to said lower flexible limb.

11. The archery bow described in claim 9, wherein said upper rearward extending portion and said lower rearward extending portion are separate pieces that are mounted to vertical riser structure.

12. The archery bow described in claim 11, wherein at least one of said rearward extending portions is made of two vertical parallel plates mounted to and extending rearward from said vertical riser structure, and wherein said flexible limb is mounted in a gap between said plates.

13. The archery bow as described in claim 9, wherein the base of said flexible limb is attached within a vertex defined by a vertical axis of said vertical riser assembly and a rearward axis of one of said rearward extending portions.

14. The archery bow described in claim 9, comprising a brace mounted on one of said rearward extending portions and spaced along the length of said flexible limb from the mounted base of said limb, wherein said brace defines a fulcrum point around which said flexible limb can bend, and wherein the position of said brace with respect to said riser assembly is adjustable by moving the position of said brace towards or away from said vertical riser assembly to change the fulcrum position applied to said flexible limb.

15. An archery bow, comprising:

a rigid vertical riser assembly defining a vertical axis and including at least one non-bending rearward extending portion defining a longitudinal axis;

upper and lower rotatable elements mounted to said vertical riser assembly;

a cable arrangement defining a bowstring, said bowstring forming upper and lower cable portions which each form a medial portion respectively trained around said upper and lower rotatable elements so that said bowstring extends directly between the upper and lower rotatable elements;

an internal angle toward the bowstring defined by the longitudinal axis of said rearward extending portion and the vertical axis of said vertical riser assembly;

at least one flexible limb wherein the base of said limb is attached to said riser assembly and wherein said flexible limb extends rearward within said internal angle;

wherein said cable arrangement further includes a return cable portion extending at one end from at least one of said upper and lower rotatable elements with an opposite opposing end of said return cable portion attached to said flexible limb said return cable portion extending directly between one of said upper and lower rotatable elements and said at least one flexible limb; and, wherein drawing said bowstring applies force to said flexible limb causing said limb to bend and store energy.

16. The archery bow described in claim 15, wherein said riser assembly includes two of said rearward extending portions each defining a longitudinal axis and two flexible limbs wherein each of said flexible limbs is situated in an internal angle defined by a longitudinal axis of a respective one of said extending portions and the vertical axis of said vertical riser assembly.

17. The archery bow as described in claim 15, wherein the base of said flexible limb is mounted within the vertex of said vertical axis and said longitudinal axis.

18. The archery bow as described in claim 15 comprising, an attachment point of said cable arrangement to said flexible limb;

wherein a vertical distance is defined between said attachment of said cable arrangement to said flexible limb and said rotatable element and a horizontal distance is defined between said attachment point of said cable arrangement to said flexible limb and said rotatable element;

wherein said vertical distance is greater than said horizontal distance so that when a force is applied to said flexible limb by said cable arrangement, said force is primarily vertical force; and, wherein said return cable portion is angled rearwardly within said vertical distance and said horizontal distance from said attachment point toward said rotatable element.

19. The archery bow described in claim 15, wherein said at least one rearward extending portion is a separate piece that is mounted to a vertical riser structure.

20. The archery bow described in claim 15, wherein said riser assembly comprises a brace spaced along the length of said flexible limb from the attached base of said limb, wherein said brace defines a fulcrum point around which said flexible limb can bend and wherein said brace is adjustable by moving the position of said brace towards or away from said rigid vertical riser assembly so that the point along the limb at which said brace acts as a fulcrum can be changed.

* * * * *